US009331412B2

(12) United States Patent
Moser

(10) Patent No.: US 9,331,412 B2
(45) Date of Patent: May 3, 2016

(54) PRESS-IN PIN FOR AN ELECTRICAL PRESS-IN CONNECTION BETWEEN AN ELECTRONIC COMPONENT AND A SUBSTRATE PLATE

(75) Inventor: Manfred Moser, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 26 days.

(21) Appl. No.: 14/127,722

(22) PCT Filed: May 29, 2012

(86) PCT No.: PCT/EP2012/059970

§ 371 (c)(1),
(2), (4) Date: Dec. 19, 2013

(87) PCT Pub. No.: WO2012/175286

PCT Pub. Date: Dec. 27, 2012

(65) Prior Publication Data

US 2014/0113504 A1 Apr. 24, 2014

(30) Foreign Application Priority Data

Jun. 21, 2011 (DE) ..... 10 2011 077 915

(51) Int. Cl.
*H01R 13/03* (2006.01)
*H01R 12/58* (2011.01)
*H01R 13/41* (2006.01)

(52) U.S. Cl.
CPC ..... *H01R 13/03* (2013.01); *H01R 12/585* (2013.01); *H01R 13/41* (2013.01)

(58) Field of Classification Search
CPC ..... H01R 12/585; H01R 13/03
USPC ..... 439/82, 751, 943, 886
See application file for complete search history.

(56) References Cited

U.S. PATENT DOCUMENTS 3,582,978 A * 6/1971 Petersen ..... H01J 29/925 174/50.52
2005/0176267 A1* 8/2005 Saitoh ..... H01R 12/585 439/49

(Continued)

FOREIGN PATENT DOCUMENTS

| | | |
|---|---|---|
| DE | 3936843 | 5/1990 |
| DE | 202008015028 | 3/2009 |
| DE | 102009008118 | 8/2009 |
| EP | 1755195 | 2/2007 |

(Continued)

OTHER PUBLICATIONS

International Search Report for Application No. PCT/EP2012/059970 dated Sep. 10, 2012 (2 pages).

*Primary Examiner* — Abdullah Riyami
*Assistant Examiner* — Justin Kratt
(74) *Attorney, Agent, or Firm* — Michael Best & Friedrich LLP

(57) ABSTRACT

The invention relates to a press-in pin (1, 2) for an electrical press-in connection between an electronic component (3) and a substrate plate (4) with an electrical contact hole (5). The press-in pin (1, 2) has a press-in pin head (6) which has a press-in head length ($I_K$) which is matched to a thickness (d) of the substrate plate (4). A press-in pin leg (7) extends between the electronic component (3) and the press-in pin head (6). A press-in pin collar (13) forms a transition between the press-in pin leg (7) and the press-in pin head (6) and has a locking projection (14). The press-in pin head (6) is coated with a layer (20) of a lead-free tin alloy (15). At least the press-in pin collar (13) with the locking projection (14) has an electrically insulating coating (16).

15 Claims, 4 Drawing Sheets

(56) References Cited

U.S. PATENT DOCUMENTS

| | | | | |
|---|---|---|---|---|
| 2008/0057767 | A1* | 3/2008 | O'Rourke | H01R 31/02 439/345 |
| 2009/0239398 | A1* | 9/2009 | Lynch | H01R 12/585 439/81 |

FOREIGN PATENT DOCUMENTS

| | | |
|---|---|---|
| GB | 826634 | 1/1960 |
| JP | 2005252064 | 9/2005 |
| JP | 2010186658 | 8/2010 |
| WO | 2009/141075 | 11/2009 |

* cited by examiner

PRESS-IN PIN FOR AN ELECTRICAL PRESS-IN CONNECTION BETWEEN AN ELECTRONIC COMPONENT AND A SUBSTRATE PLATE

BACKGROUND OF THE INVENTION

The invention relates to a press-in pin for an electrical press-in connection between an electronic component and a substrate plate with an electrical contact hole.

A press-in zone of such a press-in pin is usually covered with a tin layer which forms a low-resistance metallic contact when pressed into a metalized contact hole of the substrate plate. Lead-free tin alloys comprising a tin content of over 90 wt % tend to relieve mechanical stresses by the transport of ions while forming thread-like monocrystalline whiskers. This entails the risk that the thread-like monocrystalline whiskers that are several millimeters long cause short circuits on the substrate plate, in particular between adjacent contact regions, which short circuits cannot be tolerated by electronic components such as ABS or ESP circuits in motor vehicles. On account of considerations regarding recycling and environmental protection, the tin-lead alloys in tin coatings of a press-in pin, which prevent whiskers from forming, are however also not tolerable, in particular in the case of motor vehicle components which are increasingly intended to be recycled.

A method for protecting tin layers from whisker formation is disclosed by the German patent publication DE 1 093 097. In this method, a precious metal layer, preferably consisting of gold, is deposited on a practically pure, lead-free tin layer which was previously deposited. This not only has the disadvantage of an additional, complicated and also expensive (due to the precious metal) further deposition step but can also lead to problems of solderability of the tin coating when the deposited layer is too thick. In particular in the known method, the production of a press-in pin connection, in which a 50 angstrom thick gold layer would have to be removed and rendered ineffective, is not of primary importance but rather a long shelf life of components comprising tin coated contact pins is intended to be achieved, said contact pins being intended to be soldered in a stress relieved manner when being mounted to the substrate plates in a stress relieved manner. A press-in pin is however intended to save exactly this step of fusion soldering to a substrate plate.

Furthermore, the Japanese patent specification JP 2005 25 20 64 A discloses a connecting piece for flexible printed circuit boards or flexible flat cables and plugs, wherein whiskers can be prevented from forming in the case of said connecting pieces by liquid resin being injected around a friction-welded connection between the contact surface of the printed circuit board and the flat cable terminal planarly applied to said connecting piece. The resin is intended to protect the planar connecting region between the copper connection of the substrate and the tin coating of the flat cable applied to said connecting piece. In the case of this disclosed connecting piece, the whisker formation on tin coatings is prevented by a subsequent resin coating of the copper-tin connection; however, a whisker formation is not thereby prevented after the tin coated press-in pin of an electronic component has been pressed into a contact hole of a substrate plate.

SUMMARY OF THE INVENTION

With the invention, a press-in pin for an electrical press-in connection between an electronic component and a substrate plate with an electrical contact hole is created. The press-in pin has a press-in pin head which has a press-in head length which is matched at least to a thickness of the substrate plate. A press-in pin leg extends between the electronic component and the press-in pin head. A press-in pin collar forms a transition between the press-in pin leg and the press-in pin head and has a locking projection or a press-in pin shoulder. The press-in pin head is coated with a lead-free tin alloy. At least the press-in pin collar comprising the locking projection has an electrically insulating coating.

The electrical contact hole can additionally be coated with a metal alloy and the tin alloy of the press-in pin head can form a materially bonded, frictional connection with the metal alloy of the contact hole when the press-in pin is pressed into the substrate plate. In so doing, an intensive materially bonded contact of the metallization of the contact hole, which normally consists of a copper alloy that can be coated with a precious metal in this region, is formed with the lead-free tin alloy, which has a tin content of over 90 wt %, without entailing the risk that a long term whisker formation can occur. This results particularly from the fact that the inventive press-in pin collar with the locking projection has an electrically insulating coating; thus enabling the entire contact hole on the upper side of the substrate plate to be protected from a whisker formation by means of the press-in pin collar, which is electrically insulated towards the outside, after pressing in the press-in pin head, which is provided with a tin coating.

According to the invention, provision is further made to not only provide the press-in pin collar comprising the locking projection with an insulating coating but to additionally coat at least a lower part of the press-in pin leg so as to be electrically insulated from the press-in pin collar.

Such an electrically insulating coating can comprise a polymer from the group of thermosetting plastics which have a cross-linking of polymer molecular chains at a suitable curing temperature and thereby can ensure a long-lasting protection of the press-in pin from whisker formations. The coating to be provided above a press-in zone can comprise a non-conductive passivation layer. The coating can, e.g., comprise an organic passivation layer (OSP, "Organic Surface Protection").

The electrically insulating coating can be selectively sprayed on, dip coated or painted on, wherein at least the locking projection and the press-in pin collar are to be selectively provided with the electrically insulating coating; however, coatings which also extend beyond these regions and possibly cover even parts of the press-in pin head are not harmful to the actual press-in process. This results from the fact that shear forces occurring when pressing the press-in pin into the metalized contact hole shear off excess portions of the electrically insulating coating and expose the tin solder layer of the press-in pinhead for a materially bonded frictional connection between the tin coating and the metallization of the contact hole.

The tin content [Sn] of the lead-free tin alloy coating lies between 90 wt %≤[Sn]≤100 wt %. As a result, the lead-free tin alloy has a thickness $d_{Sn}$ between 5 μm≤$d_{Sn}$≤50 μm and can be galvanically deposited, dip coated or physically applied.

In contrast, the electrically insulating coating can be embodied significantly thinner and have a minimum coating thickness $d_{iso}$ of 0.5 μm. There is no maximum limit; however, it is recommended that that the thickness of the insulating coating $d_{iso}$ lies between 0.5 μm≤$d_{iso}$≤50 μm in order to ensure an adequate clearance between a plurality of press-in pins of a component.

An effective electrical press-in connection can thereby be produced, in that the press-in pin head of the press-in pin is pressed into the contact hole of the substrate plate, for example in the form of a printed circuit board, and in so doing a gas-tight electrical connection is produced, which can lead to the materially bonded, metallic frictional connection mentioned above when the interference fit between press-in pin head of the press-in pin and contact hole is appropriately designed. Moreover, it is possible to provide flexible press-in zones on a press-in pin head, which specifically have resilient characteristics; thus enabling the mechanical forces during the press-in operation to be absorbed predominantly by the press-in pin head itself.

On the other hand, it is also possible to provide massive press-in zones on the press-in pin head so that the press-in pin head does not resiliently deform; however, the tin alloy coating is plastically deformed and the force during the press-in operation is predominantly absorbed by the contact hole of the substrate plate.

To this end, the cross section of a press-in pin head comprising massive press-in zones is designed to be square or polygonal; thus enabling a press-in operation, for example, in a round metallic contact hole, to cause a cold frictional weld due to the massive edges of said cross section.

In many applications, the invention as solderless joining technology provides an advantageous alternative to pure thermal soldering technology. These advantages are not solely restricted to eliminating a heating step, such as a soldering operation, but an electrical connection free of contact resistance can be created between the tin coating of the press-in pin head and the contact material of the contact hole of the substrate plate due to the shape and elasticity of the press-in pin head in conjunction with the lead-free tin coating. In addition, a plurality of press-in pin heads of press-in pins of a component can be suitably inserted in a single press-in step into prepared contact holes of the substrate plate without after-treatment and without an increased processing temperature.

As a result of the electrically insulating coating applied to the press-in pin collar comprising the locking projection, the long term stability for such press-in pin connections is practically ensured because the threadlike whisker formation is prevented. A further advantage of the press-in pin according to the invention is that a sufficient long term stability is now also ensured for applications of the electronics that are critical to the safety of the passengers, for example in the case of ABS or ESP systems in motor vehicles; thus enabling the solders containing lead which were indispensable up until now to be eliminated.

In addition, the large amount of effort and expense which is connected to the introduction and application of intermediate layers for suppressing the whisker growth, such as, for example, nickel, silver or gold coatings, is eliminated. The mechanical stresses, which are responsible for the whisker formation and which can also occur with clamping and screw-connection pins in structural components and occur particularly extremely with press-in pins, can continue to be maintained because the electron and ion transport, which besides the mechanical stresses is additionally required for the whisker formation, is prevented by the insulating coating.

BRIEF DESCRIPTION OF THE DRAWINGS

Further aspects and advantages of the invention are now described in more detail with the aid of the attached figures. In the drawings.

DETAILED DESCRIPTION

Figure 1:
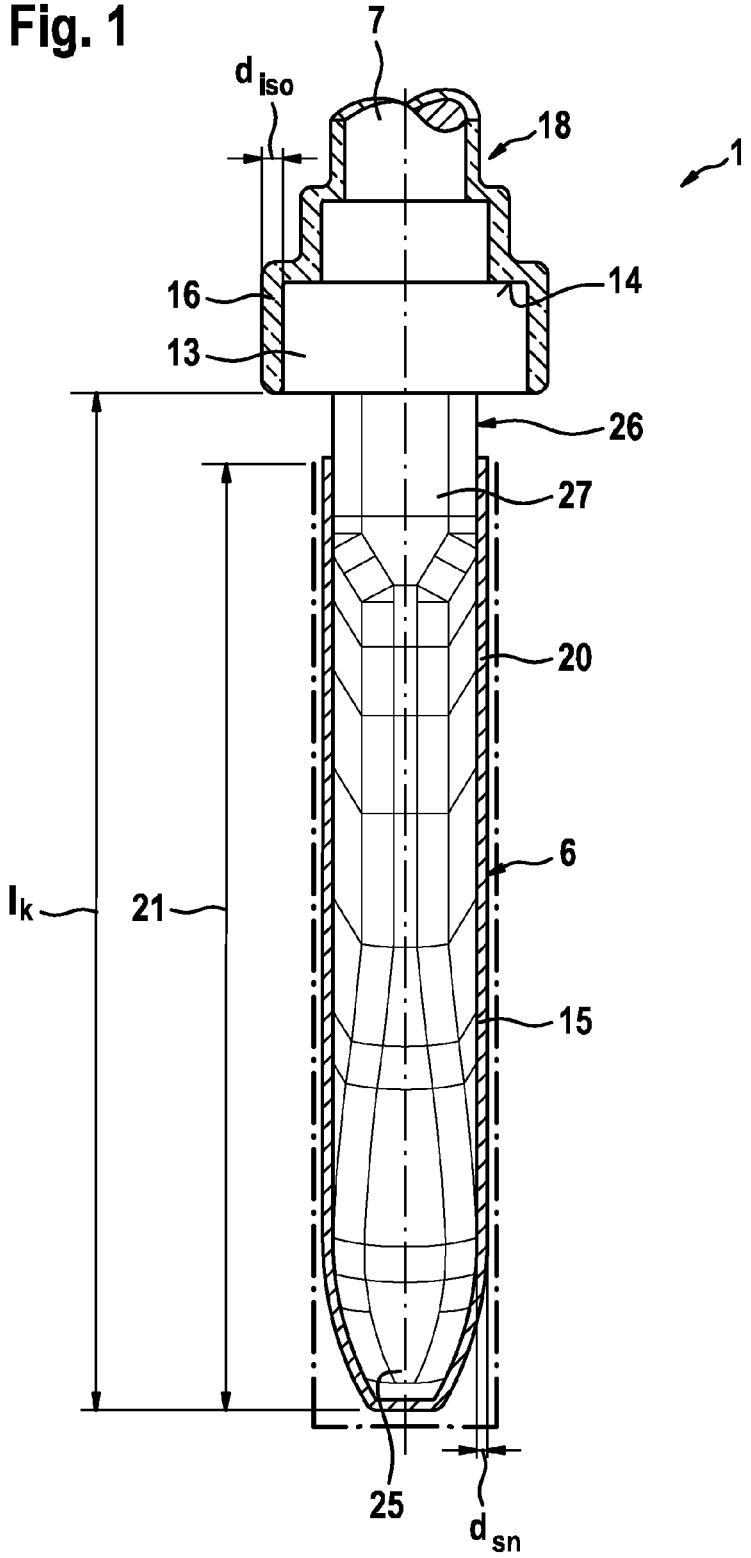
FIG. 1 shows a schematic view of a press-in pin head of a press-in pin according to a first embodiment of the invention.

FIG. 1 shows a schematic view of a press-in pin head 6 of a press-in pin 1 according to a first embodiment of the invention. The press-in pin head 6 has a length $l_K$ which is matched to the thickness of a substrate plate depicted in FIG. 4. In this first embodiment of FIG. 1, the tip 25 of the press-in pin 6 has an oval shape in the longitudinal section thereof, the cross section of which is matched to an interference fit to a metalized contact hole of the substrate plate shown in FIG. 4. The oval tip then transitions into a shape having a polygonal cross section. A massive press-in zone 21 extends approximately over the entire length $l_K$ of the press-in pin head 6 and is covered by a layer 20 consisting of a tin alloy 15, which has a thickness between $5\ \mu m \leq d_{Sn} \leq 50\ \mu m$ and a tin content [Sn] between 90 wt %≤[Sn]≤100 wt %.

A press-in pin collar 13 adjoins the press-in pin head 6, which collar transitions via a locking projection or, respectively, a press-in pin shoulder 14 into a press-in pin leg 7. In so doing, the press-in pin leg 7 can have arbitrary cross sections. It is decisive that the contact hole in the substrate plate is completely covered with the aid of the locking projection 14; thus enabling the press-in pin 1 to be locked in place on the upper side of the substrate plate when the press-in pin 1 is pressed into the contact hole. In order to prevent threadlike whiskers from cropping out of the tin alloy 15 that has been pressed in under tension, at least the press-in collar 13 and the locking projection 14 are coated with an electrically insulating coating 16 consisting of thermosetting plastic in a thickness $d_{iso}$ between $0.5\ \mu m \leq d_{iso} \leq 50\ \mu m$.

A tin-free region 26 is furthermore provided on a press-in pin shank 27 of the press-in pin head 6 at the transition to a press-in pin collar 13 in order to provide a space reserve for sheared off tin volume without said tin volume being squeezed out of the contact hole. This simultaneously ensures that the press-in pin collar with the projection 14 thereof and the insulating coating 16 constitutes a durable and long term protection from a whisker formation and a growth of tin whiskers out of the contact hole is prevented.

Figure 2:
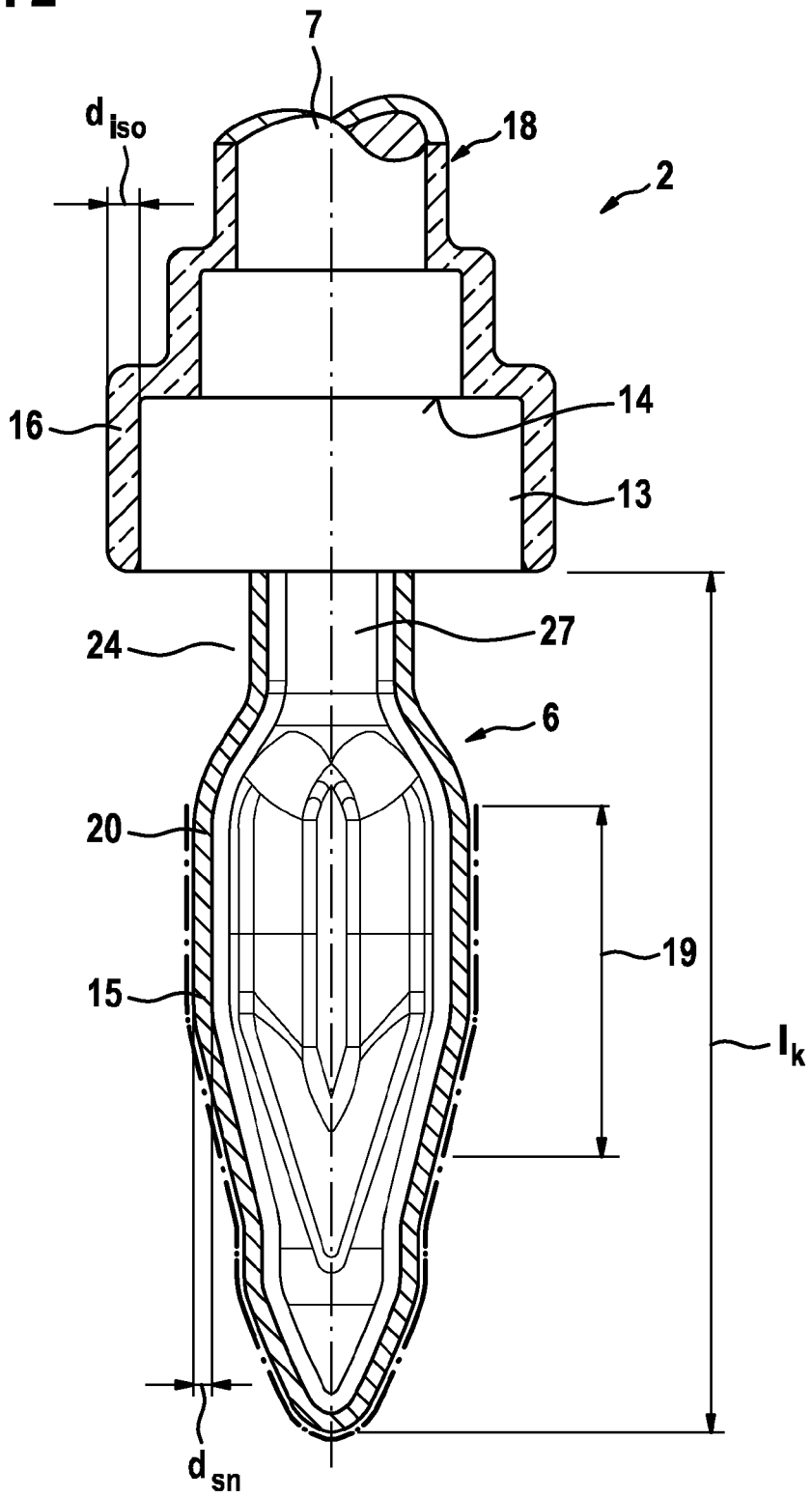
FIG. 2 shows a schematic view of a press-in pin head of a press-in pin according to a second embodiment of the invention.

Whereas in FIG. 1 a press-in pin head 6 comprising a massive press-in zone 21 in the region having a polygonal cross section is shown, which can form with the massive polygonal edges thereof a frictional metallic connection with the metallization of a contact hole, a schematic view of a press-in pin head 6 of a press-in pin 2 according to a second embodiment of the invention is shown in FIG. 2. This second embodiment of the invention differs from the first embodiment by the press-in pin head 6 having flexible press-in zones 19 so that the press-in force from the press-in pin head 6 and therefore from the press-in pin 2 itself is absorbed and a deformation of the contact hole and therefore of the substrate plate is prevented. Components having identical functions as in FIG. 1 are denoted with the same reference numerals in FIG. 2 and are not discussed separately.

It is furthermore characteristic of the embodiment in FIG. 2 that the dot and dashed line which identifies the press-in zone region in the second embodiment of the press-in pin 2 lies closely to the flexible contour of the press-in pin head 6. In addition, a significantly larger space reserve for collecting sheared off tin alloy 15 is provided in the region of the press-in pin shank 27 of the press-in pin head 6 at the transition of said press-in pin head 6 to the press-in pin collar 13. A further difference of said second embodiment of the invention is that the cross section of this press-in pin head is approximately round and flexibly matches to the diameter of the contact hole when being pressed into said contact hole, as is shown in the following FIG. 4.

Figure 3:
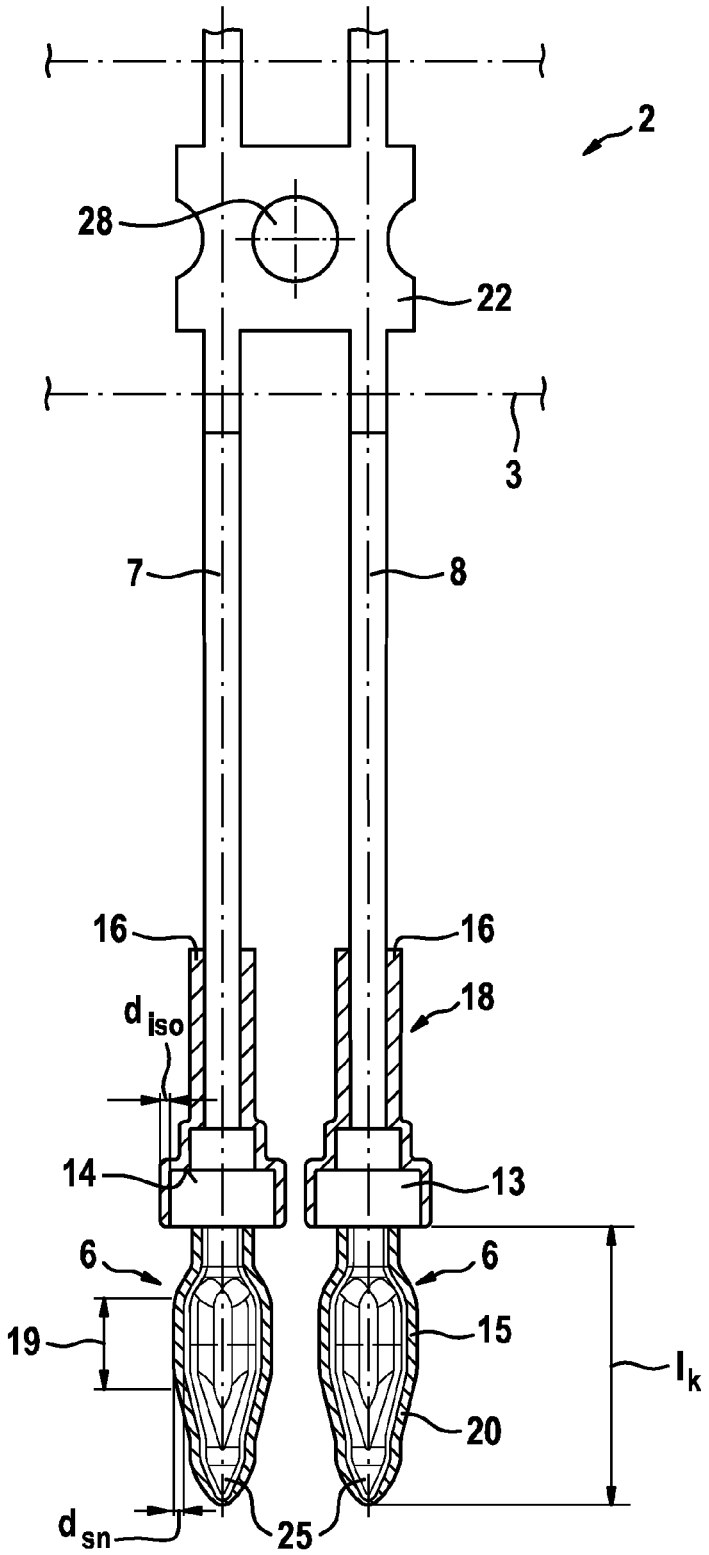
FIG. 3 shows a pair of the press-in pins pursuant to FIG. 2 comprising a connecting location of an electronic component.

FIG. 3 shows a single pair of the press-in pins 2 according to FIG. 2 comprising a connecting location for an electronic component 3. As a result, the pair of press-in pins 2 can be fixed via a connector hole 28 in the connecting location 22 to the electronic component 3. Two press-in pin legs 7 and 8 lead from the position of the electronic component 3 comprising the connecting location 22 to the respective press-in pin collar 13 which with the respective locking projection 14 prevents the press-in pin legs 7 and 8 from penetrating into the contact holes of the substrate plate. Whiskers can be prevented from forming by the electrically insulating coating 16 which on the one hand covers the press-in pin collar 13 comprising the locking projection 14 and in this embodiment additionally insulates a portion 18 of the press-in pin legs 7 and 8.

Figure 4:
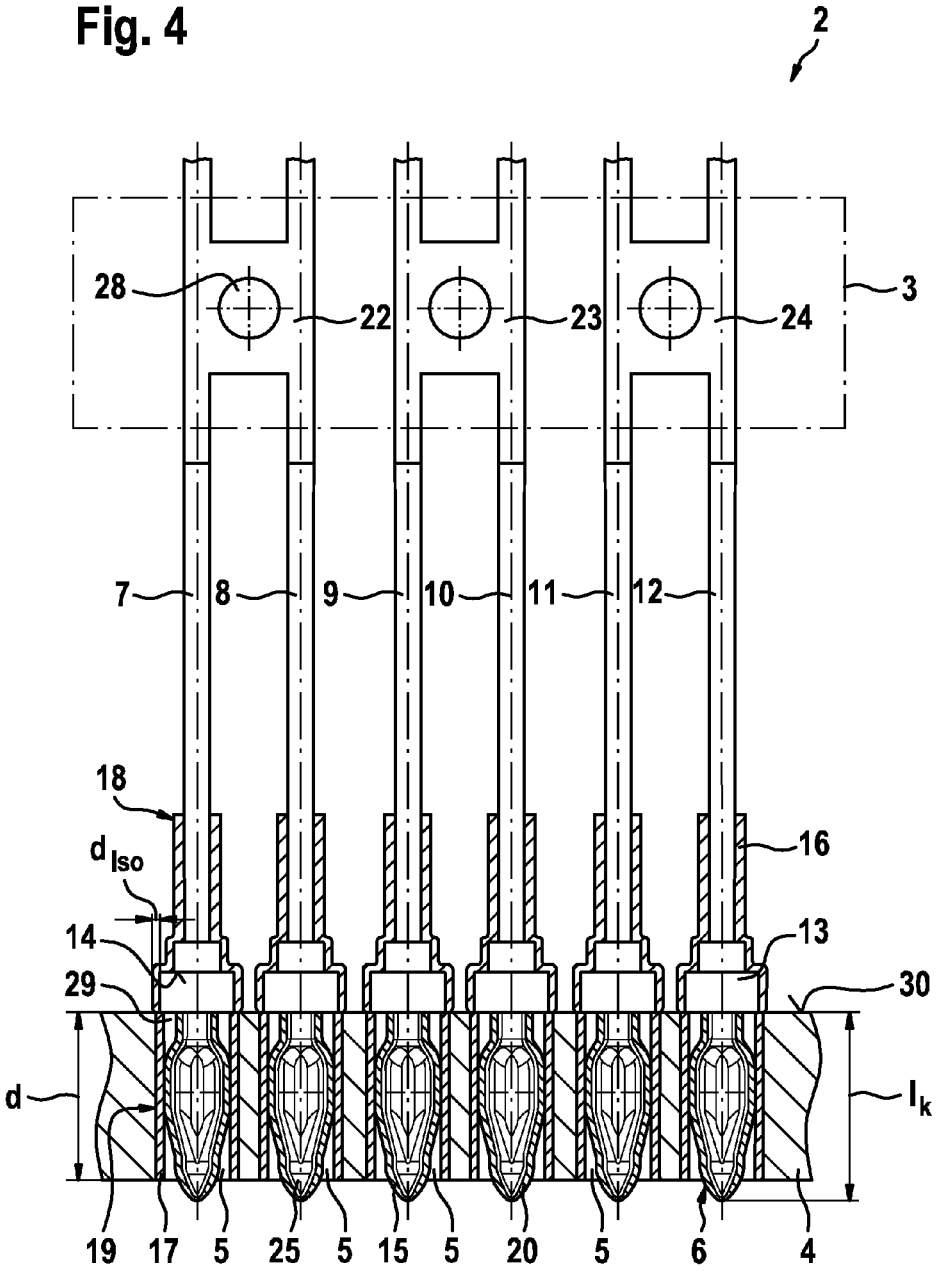
FIG. 4 shows a plurality of press-in pins pursuant to FIG. 2 comprising a plurality of connecting locations for connections to an electronic component.

FIG. 4 shows a plurality of press-in pins according to FIG. 2 having a plurality of connection locations 22, 23, 24 for connections to an electronic component 3, which is designated here with a dot and dashed line. The substrate plate 4 has metalized contact holes 5, which have a metal alloy 17 on the inner walls thereof. For that reason, the length $I_K$ of the press-in pin heads 6 is matched to the thickness d of a substrate plate 4. The substrate plate 4 itself consists of an insulating printed circuit board material and comprises conductor paths consisting of a copper alloy on the top and bottom side thereof in order to connect the electronic component 3 to other components via press-in pin legs 7 to 12. Due to the high power requirement of the electronic component 3, the press-in pin legs 7 and 8, 9 and 10 as well as 11 and 12 are provided in pairs for the connection location 22, 23 or 24. In addition, not only the press-in pin collar 13 comprising the locking projection 14 is provided with an insulating coating, but also a portion 18 of the press-in pin legs 7 to 12 in the connection to the press-in pin collar 13. FIG. 4 also makes clear that a considerable space reserve 29 is maintained in the region of the press-in pin shank 27 which space reserve can receive tin volume that has been sheared off by shear forces when pressing in the press-in tin head 6 without said tin volume being squeezed or pressed out of the contact hole 5 in the direction of a top side 30.

As already mentioned above, the press-in pin heads 6 of this second embodiment of the press-in pins 2 is designed such that said heads yield elastically and flexibly when pressed into a contact hole 5. The press-in forces are therefore directly absorbed by press-in pin heads 6 and do not deform the substrate plate 4 or more precisely the contact hole 5 of the substrate plate 4.

The invention is not limited to the exemplary embodiments described here and the aspects featured therein, but rather a plurality of modifications are possible within the area specified by the attached claims, said modifications lying within the scope of actions taken by a person skilled in the art.

The invention claimed is:

1. A press-in pin for an electrical press-in connection between an electronic component (3) and a substrate plate (4) with an electrical contact hole (5) comprising:

a press-in pin head (6) which has a press-in head length ($I_K$), a press-in pin leg (7) which extends between the electronic component (3) and the press-in pin head (6), a press-in pin collar (13) which forms a transition between the press-in pin leg (7) and the press-in pin head (6) and has a locking projection (14), wherein the press-in pin head (6) is coated with a layer (20) of a lead-free tin alloy (15), and at least the press-in pin collar (13) with the locking projection (14) has an electrically insulating coating (16) formed as a non-conductive passivation layer.

2. The press in pin according to claim 1, wherein the contact hole (5) is coated with a metal alloy (17) and the tin alloy (15) of the press-in pin head (6) forms a materially bonded frictional connection with the metal alloy (17) of the contact hole (5).

3. The press in pin according to claim 1, wherein, starting from the press-in pin collar (13), the electrically insulating coating (16) covers at least a portion (18) of the press-in pin leg (7).

4. The press in pin according to claim 1, wherein the electrically insulating coating (16) comprises a polymer from the group of thermosetting plastics.

5. The press in pin according to claim 1, wherein the electrically insulating coating (16) is sprayed on.

6. The press in pin according to claim 1, wherein the electrically insulating coating (16) has a thickness $d_{iso}$ between $0.5\ \mu m \leq d_{iso} \leq 50\ \mu m$.

7. The press in pin according to claim 1, wherein the lead-free tin alloy (15) has a tin content [Sn] between 90 wt $\% \leq [Sn] \leq 100$ wt % formed as a non-conductive passivation layer.

8. The press in pin according to claim 1, wherein the layer (20) consisting of the lead-free tin alloy (15) has a thickness $d_{Sn}$ between $5\ \mu m \leq d_{Sn} \leq 50\ \mu m$ and is galvanically deposited.

9. The press in pin according to claim 1, wherein the press-in pin head (6) has flexible press-in zones.

10. The press in pin according to claim 1, wherein the press-in pin head (6) has massive press-in zones (21).

11. The press-in pin according to claim 1, wherein the electrically insulating coating (16) is dip coated.

12. The press-in pin according to claim 1, wherein the electrically insulating coating (16) is painted on.

13. The press-in pin according to claim 1, wherein the layer (20) consisting of the lead-free tin alloy (15) has a thickness $d_{Sn}$ between $5\ \mu m \leq d_{Sn} \leq 50\ \mu m$ and is dip coated.

14. The press-in pin according to claim 1, wherein the layer (20) consisting of the lead-free tin alloy (15) has a thickness $d_{Sn}$ between $5\ \mu m \leq d_{Sn} \leq 50\ \mu m$ and is physically applied.

15. The press-in pin according to claim 1, wherein the non-conductive passivation layer is formed as an organic passivation layer.

* * * * *